US006252507B1

(12) United States Patent
Gagnon

(10) Patent No.: US 6,252,507 B1
(45) Date of Patent: Jun. 26, 2001

(54) INTRUSION DETECTION SYSTEM USING QUIET SIGNAL BAND DETECTION

(75) Inventor: André Gagnon, Hull (CA)

(73) Assignee: Auratek Security Inc., Hull (CA)

( * ) Notice: Subject to any disclaimer, the term of this patent is extended or adjusted under 35 U.S.C. 154(b) by 0 days.

(21) Appl. No.: 09/230,986

(22) PCT Filed: Jun. 5, 1998

(86) PCT No.: PCT/CA96/00551

§ 371 Date: Feb. 3, 1999

§ 102(e) Date: Feb. 3, 1999

(87) PCT Pub. No.: WO98/55972

PCT Pub. Date: Dec. 10, 1998

(30) Foreign Application Priority Data

Jun. 6, 1997 (CA) ..... 2207119

(51) Int. Cl.[7] ..... G08B 13/18

(52) U.S. Cl. ..... 340/552; 340/567; 340/539

(58) Field of Search ..... 340/552, 539, 340/551, 553, 554, 561, 562, 563, 564, 565, 566, 567

(56) References Cited

U.S. PATENT DOCUMENTS

| | | | | |
|---|---|---|---|---|
| 3,163,861 | * | 12/1964 | Suter | 340/552 |
| 4,224,607 | * | 9/1980 | Poirier et al. | 340/552 |
| 4,419,659 | | 12/1983 | Harman et al. . | |
| 4,612,536 | * | 9/1986 | Harman | 340/552 |
| 4,761,796 | | 8/1988 | Dunn et al. . | |
| 5,473,336 | * | 12/1995 | Harman et al. | 343/790 |
| 5,510,766 | * | 4/1996 | Harman et al. | 340/552 |
| 5,534,869 | * | 7/1996 | Harman | 342/27 |

FOREIGN PATENT DOCUMENTS

| | | |
|---|---|---|
| WO 91 13415 | 9/1991 | (WO) . |
| WO 94 07222 | 3/1994 | (WO) . |
| WO 97 22955 | 6/1997 | (WO) . |

OTHER PUBLICATIONS

Synergistic Radar–Radioguard application and Performance, Harman, K. et al Proceedings of the International Carnaham Conference of Security Technology, Taipei, Oct. 13–15, 1993.

* cited by examiner

*Primary Examiner*—Benjamin C. Lee
(74) *Attorney, Agent, or Firm*—Thomas Adams

(57) ABSTRACT

In an intrusion detection system of the kind which comprises a "leaky cable" or open transmission line and is used to determine the presence of objects, things or people moving in the vicinity of the leaky cable, a transmitting antenna and a receiving antenna, one of which is an open transmission line/leaky cable, are connected to a transmitter unit and a receiver unit, respectively. A control unit controls both the transmitter unit and the receiver unit, and causes the receiver unit to scan a preselected radio band, with the transmitter unit not transmitting, to detect one or more relatively quiet portions of the band in which instant received signal levels are lower than a predetermined threshold. The control unit selects a plurality of disparate frequencies in such one or more relatively quiet portions and subsequently causes the transmitter unit to transmit signals by way of the transmitting antenna at the disparate frequencies. The receiver unit receives signals corresponding to the transmitted signals and the control unit detects perturbations in the received signals caused by an intruder in the vicinity of the leaky cable to determine the presence of the intruder. The disparate frequencies may have a bandwidth equal to at least 5 per cent and preferably about 10 per cent of their mean frequency. Operation in the quiet bands allows frequency diversity to be employed, reducing the effects of standing waves and allowing the leaky cable to be deployed without a surrounding electrically-lossy medium, for example above ground, while providing uniform detection sensitivity.

15 Claims, 11 Drawing Sheets

INTRUSION DETECTION SYSTEM USING QUIET SIGNAL BAND DETECTION

DESCRIPTION

1. Technical Field

The invention relates to intrusion detection systems and methods and, in particular, to intrusion detection systems which comprise an open transmission line or so-called "leaky cable" and are used to determine the presence of objects, things or people moving in the vicinity of the leaky cable.

2. Background Art

Known intrusion detection systems use a leaky cable as a receiving antenna to receive a radio frequency signal transmitted from an associated antenna; or as a transmitting antenna to transmit signals for reception by a separate antenna, which might be another leaky cable. U.S. Pat. No. 3,163,861 and U.S. Pat. No. 5,534,869 both disclose passive systems, i.e which do not include a captive transmitter. Instead, their receivers receive signals from an independent source, i.e. a commercial FM station. In the case of U.S. Pat. No. 5,534,869, the receiver receives the normal transmissions from one or more commercial radio stations so as to improve reliability and to minimize the effects of multi-path signals. An advantage of such systems is that, because they don not transmit signals themselves, they do not require licensing. Unfortunately, it is sometimes necessary to deploy the intrusion detection system in a location where such signals cannot adequately be received, perhaps because the location is geographically remote or shielded. In such cases, it is appropriate to use a more traditional "active" intrusion detection system which has its own captive transmitter, such as that disclosed in Canadian patent number 1,169,939. The latter discloses a system having an RF excited antenna within an area to be protected and a leaky coaxial cable extending around the perimeter. One or more additional leaky cables may be added to avoid the possibility of intruders using a particular path which gives a null angle response.

A common problem with such intrusion detection systems, whether passive or active, is that, in certain circumstances, standing waves may be established along the surface of the leaky cable, resulting in a plurality of null positions along the cable at which the detection sensitivity is reduced and an intruder less likely to be detected. The establishment of such standing waves may be inhibited by burying the leaky cable in an electrically-lossy medium, such as the ground. Changes in soil condition, however, may lead to variations in detection sensitivity. As disclosed in U.S. Pat. No. 5,534,869 (Harman) and in U.S. Pat. No. 5,473,336 (Harman and Gagnon), it is possible to reduce such variations in sensitivity caused by the environment by means of a special cable construction involving a combination of shields. A disadvantage of this approach, however, is the relatively high cost of the cable. Moreover, it is not always convenient to bury the cable. In some cases, for example, it is desirable to leave it upon the surface or position it along the edge of a building roof or along the top of a fence.

One object of the present invention is to overcome or at least mitigate these problems and disadvantages of known systems and to provide an intrusion detection system capable of operation with relatively uniform detection sensitivity with the leaky cable above ground.

SUMMARY OF INVENTION

According to one aspect of the present invention, there is provided an intrusion detection system comprising:

a transmitting antenna and a receiving antenna, one of which is a leaky cable, a transmitter unit connected to the transmitting antenna; and a receiver unit connected to the receiving antenna;

wherein the transmitter unit transmits signals, by way of the transmitting antenna, at several disparate radio frequencies;

and the receiver unit receives by way of the receiving antenna signals corresponding to the transmitted signals;

the system further comprising means for detecting perturbations in the received signals caused by an intruder in the vicinity of the leaky cable and in dependence thereupon determining the presence of an intruder.

With such an arrangement, using transmission signals at several different frequencies, standing waves may still occur, one for each frequency, but their null points will be at different places along the leaky cable. Consequently, relatively uniform detection capability is maintained.

The transmitter may use frequency-hopping to transmit signals at the different frequencies, the receiver also using frequency-hopping and being synchronized to the transmitter for reception of the signals. Alternatively, the transmission and reception at said disparate radio frequencies may be achieved by spread-spectrum, pulsing or other suitable techniques.

In preferred embodiments of the invention, the disparate frequencies have a bandwidth of at least five per cent, and preferably about 10 per cent, of their centre frequency.

The leaky cable is a relatively inefficient antenna, so the signal it receives must be relatively strong, implying a very efficient transmitting antenna and/or a transmitted signal level which is relatively high. In many countries, regulations prohibit the use of private systems with a signal level above a prescribed limit. For example, in the United States of America, FCC regulations numbers 15.209 and 15.239 limit signal strength to 150 microvolts per meter at 3 meters and 250 microvolts per meter at 3 meters for "non-intentional" radiations and "intentional" radiations, respectively. Systems with a signal level above these levels must use an Industrial, Scientific and Medical (ISM) band which, being extremely narrow, i.e. from 40.66 MHz. to 40.70 MHz., mitigates against the use of multiple frequencies with a significant bandwidth.

A further object of the present invention, therefore, is to provide a leaky cable intrusion detection system which does not necessarily require buried cables or commercial radio station signals, yet can be used in broadcast radio bands.

According to a second aspect of the present invention, there is provided an intrusion detection system comprising a transmitting antenna and a receiving antenna, one of which is a leaky cable, a transmitter unit connected to the transmitting antenna and a receiver unit connected to the receiving antenna; and a control unit for controlling the transmitter and the receiver, the control unit controlling the receiver to scan one or more sections of the radio spectrum, with the transmitter not transmitting, and detect one or more relatively quiet portions of the spectrum in which instant received signal levels are lower than a predetermined threshold, the control unit selecting a plurality of disparate frequencies in said one or more relatively quiet portions and subsequently causing the transmitter to transmit signals by way of the transmitting antenna, at said disparate frequencies;

the receiver unit receiving signals corresponding to the transmitted signals;

the control unit detecting perturbations in the received signals caused by an intruder in the vicinity of the leaky cable and in dependence thereupon determining the presence of an intruder.

The preselected radio band may comprise at least a portion of the FM band from about 87.9 MHz. to about 107.9 MHz. and preferably extends from about 92 MHz. to about 107 MHz.

According to a third aspect of the invention, there is provided a method of detecting intruders using an intrusion detection system comprising a transmitting antenna and a receiving antenna, one of which is a leaky cable, a transmitter unit connected to the transmitting antenna and a receiver unit connected to the receiving antenna, the method comprising the steps of:

(i) using the receiver unit, scanning a preselected radio band, with the transmitter not transmitting, and detecting one or more relatively quiet portions of the band in which instant received signal levels are lower than a predetermined threshold, (ii) selecting a plurality of disparate frequencies in said one or more relatively quiet portions;

(iii) using the transmitter unit, transmitting signals by way of the transmitting antenna at the disparate frequencies;

(iv) using the receiver unit, receiving signals corresponding to the transmitted signals; and (v) detecting perturbations in the received signals caused by an intruder in the vicinity of the leaky cable and in dependence thereupon determining the presence of an intruder.

In preferred embodiments of either of the second and third aspects of the invention, the disparate frequencies have a bandwidth of at least 5 per cent, and preferably about 10 per cent, of their mean frequency.

BRIEF DESCRIPTION OF THE DRAWINGS

Preferred embodiments of the invention will now be described, by way of example only, with reference to the accompanying drawings, in which corresponding items in the different Figures have the same reference number. In the drawings.

DESCRIPTION OF THE PREFERRED EMBODIMENTS

Figure 1:
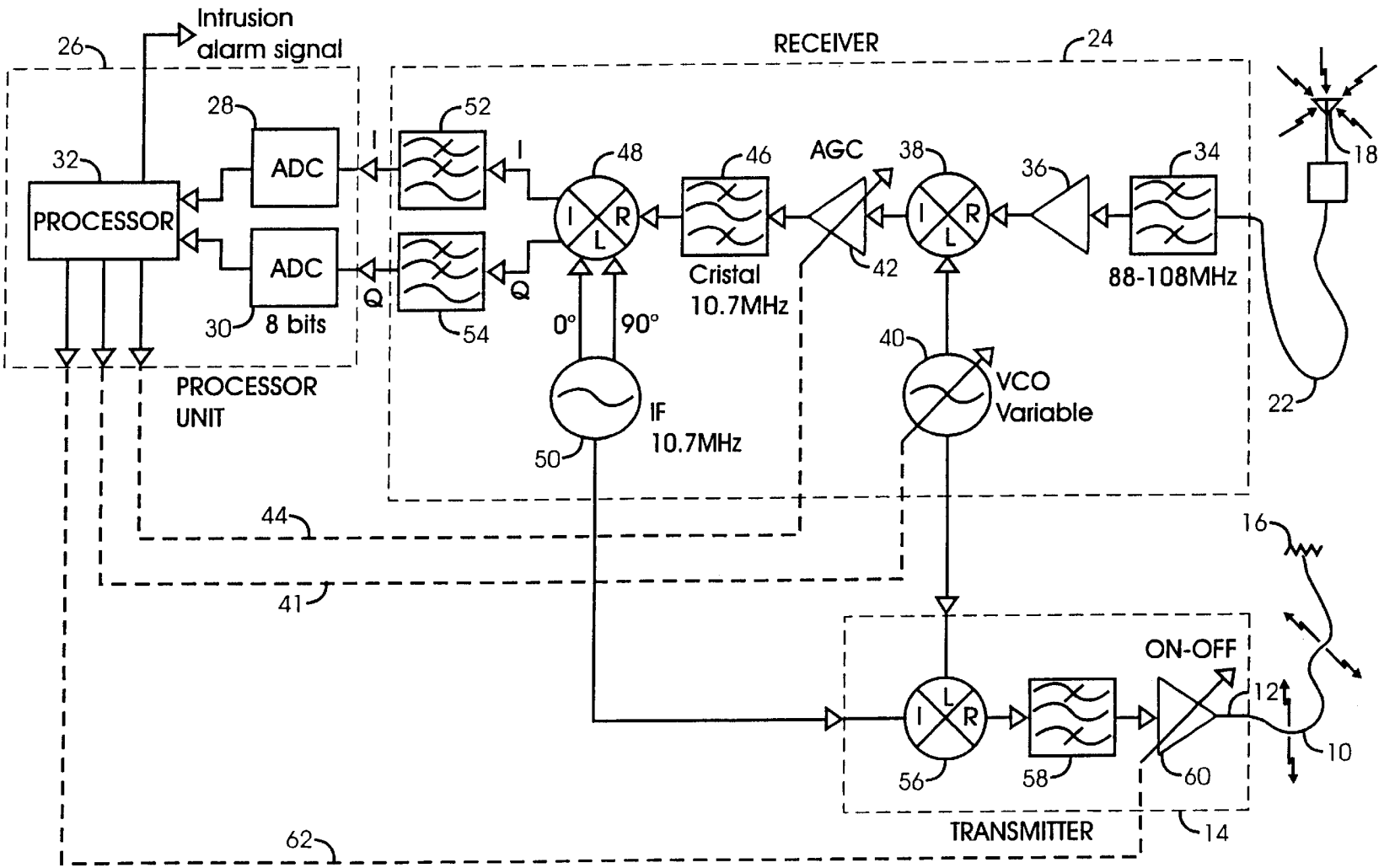
FIG. 1 is a simplified schematic diagram illustrating the transmitter, receiver and control unit of an intrusion detection system.

Referring to FIG. 1, a leaky cable intrusion detection system comprises a leaky cable 10 having one end connected by way of a coaxial lead cable 12 to a transmitter 14 and terminated at its other end by a termination impedance 16. The leaky cable 10 comprises a transmission antenna for signals from transmitter 14. An omnidirectional receiving antenna 18 is connected by a download 22 to a receiver 24 which detects the signals radiated by the leaky cable 10. The transmitter 14 and receiver 24 are both coupled to a control unit 26 which includes matched A-to-D converters 28 and 30 with their respective outputs connected to a microprocessor 32. At the input to receiver 24, the download 22 is coupled to a 88–108 MHz. bandpass filter 34 which passes signals from the receiving antenna 18 to a low noise amplifier 36. Amplifier 36 applies the amplified, filtered signals to a mixer 38 which mixes with them a variable frequency signal from a voltage controlled local oscillator (VCO) 40 which is controlled by the microprocessor 32 by way of control line 41. The output signal from mixer 38 is applied to an automatic gain control amplifier (AGC) 42 which is controlled by microprocessor 32 by way of a control line 44. The microprocessor 32 adjusts the gain of AGC 42 to compensate for differences in received signal strengths resulting from variations in the spacing between the leaky cable 10 and the reception antenna 18. The output from AGC 42 is filtered by a 10.7 MHz. bandpass filter 46, which may be a crystal filter, and applied to an in-phase and quadrature (I and Q) demodulator 48, controlled by in-phase and quadrature phase control signals (0° and 90°) from a 10.7 MHz. intermediate frequency (IF) oscillator 50. The demodulator 48 uses the phase control signals to extract the in-phase (I) and quadrature (Q) signals from the received signal and supplies them by way of respective matched low pass filters 52 and 54, respectively, to the A-to-D converters 28 and 30, respectively, of control unit 26. The low pass filters 52 and 54 remove higher frequency signal components or harmonics resulting from the mixing process.

The microprocessor 32 controls the operating frequency of both the receiver 24 and the transmitter 14 by varying the frequency of voltage controlled oscillator (VCO) 40 within the range 98.6 MHz. To 118.6 MHz., i.e. the range 87.9–107.9 MHz. plus the intermediate frequency (IF) of 10.7 MHz.

Transmitter 14 comprises a second mixer 56, second 88–108 MHz. bandpass filter 58 and two-state (on/off) amplifier 60. The microcontroller 32 controls the amplifier 60 by way of a control line 62. The transmitter mixer 56 mixes the variable frequency signal from local oscillator VCO 40 and the 10.7 MHz. IF signal from IF oscillator 50. (Although the VCO 40 and IF oscillator 50 are shown as components of the receiver 24, because they are used to control both the receiver 24 and the transmitter 14, they could well be considered to be part of the control unit 26). The transmitter mixer 56 mixes the LO and IF signals to provide a transmission signal and supplies it to 88–108 MHZ. bandpass filter 58, which removes harmonic frequencies and supplies the filtered transmission signal to switched amplifier 60. When turned on by microprocessor 32, amplifier 60 applies the transmission signal via lead line 12 to the leaky cable 10. Thus, when the microprocessor 32 adjusts the VCO 40, it will control the operating frequency of both the receiver 24 and the transmitter 14.

Figure 2A:
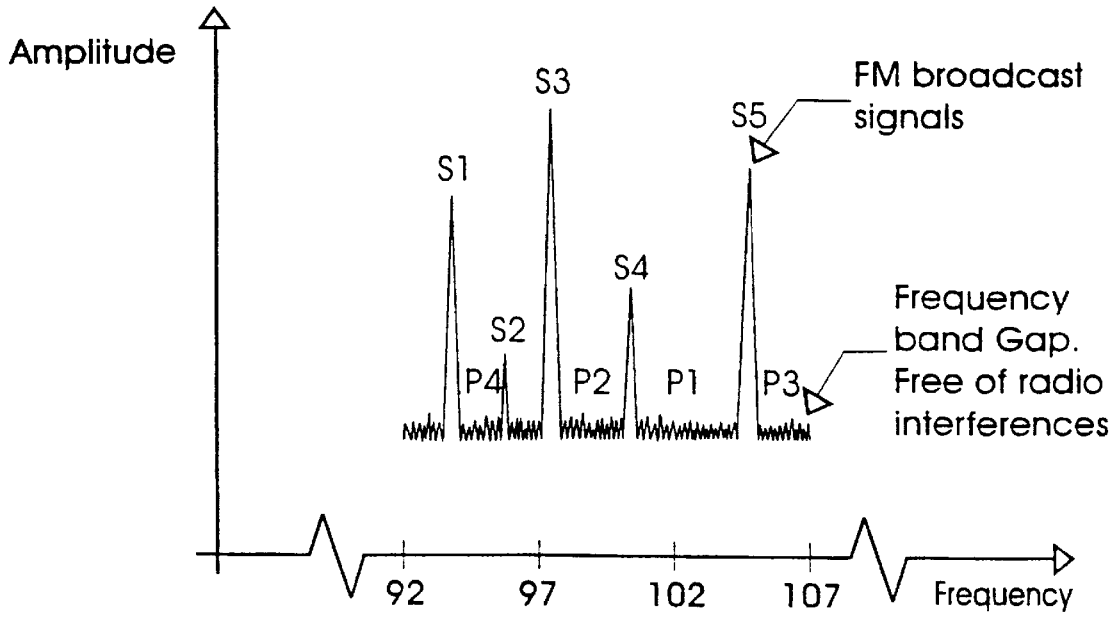
FIG. 2A illustrates a typical signal levels within the FM broadcast band, specifically from 92 MHz. to 107 MHz.

As shown in FIG. 2A, the FM broadcast band will usually have clusters of signals, identified in FIGS. 2A as S1–S5, with quiet portions between them where the signal level is so low as to be insignificant, i.e. below background noise. In FIG. 2A, these quiet portions are identified as P1–P4 where P1 represents the widest quiet portion. In operation, the microprocessor 32 will perform an initial "set up" procedure by causing the receiver 24 to scan the operating range to locate quiet portions or "gaps". The scan actually covers the range from 92 MHz. to 107 MHz. The portion from 88 to 92 MHz. is not scanned as it is mainly reserved for non-commercial FM stations or non-profit agencies, such as campus or church stations, which do not always transmit continuously. If their assigned frequency was selected while the station was off-air, interference would occur as soon as the station started transmitting again. Limiting to 107 MHz. allows a 1 MHz. margin to reduce the risk of interference with aircraft navigation bands above 108 MHz.

During initial scanning of the operating frequency band to determine the quiet portions, the microprocessor 32 will turn off the two-state amplifier 60, so that no signals will be transmitted by the transmitter 14 during the initial scanning, and will adjust the gain of AGC to maximum.

Figure 2B:
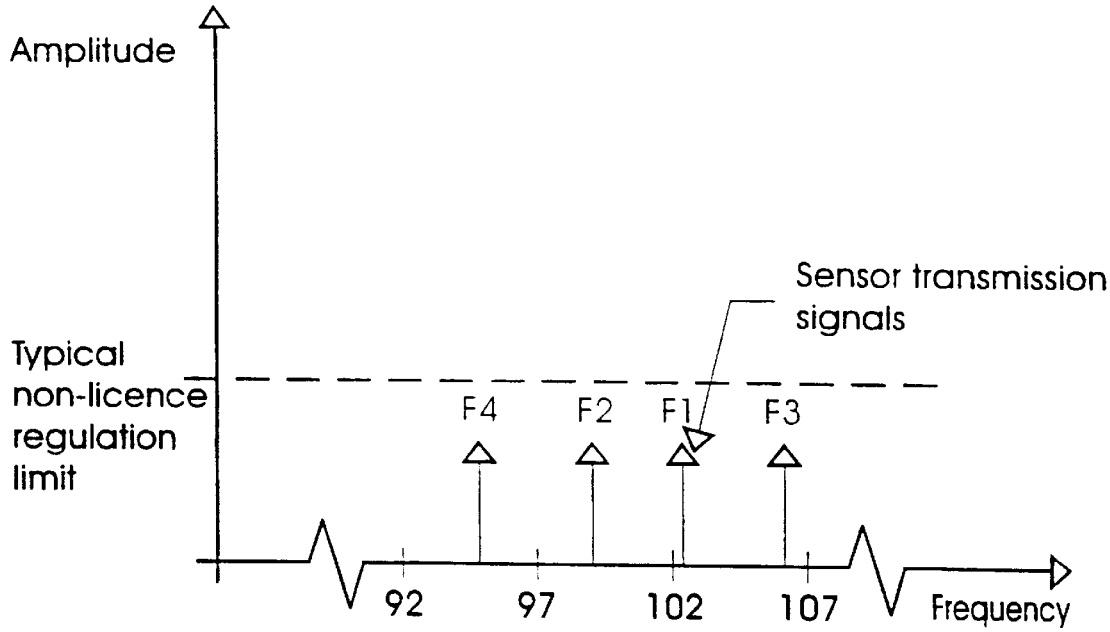
FIG. 2B illustrates selection of quiet portions of the broadcast band for transmission of signals by the transmitter of FIG. 1.

Once the initial scanning has been performed, and the microprocessor 32 has determined the quiet portions which may be used, the microprocessor 32 will select a set of transmission frequencies located in the quiet portions, turn on the two-state amplifier 60, and then repeatedly adjust the VCO 40 to each of the selected transmission frequencies in turn. As a result, the transmitter 14 will transmit signals at those frequencies, identified in FIG. 2B as f1, f2, f3 and f4, and the receiver 24 will track the transmitter 14 to receive signals at the same frequencies. Such frequency-hopping is a technique known to persons skilled in this art, so it will not described in detail here. As illustrated in FIG. 2B, the amplitude of the transmitted signals is less than the limit specified for non-licenses usage.

Figure 3A:
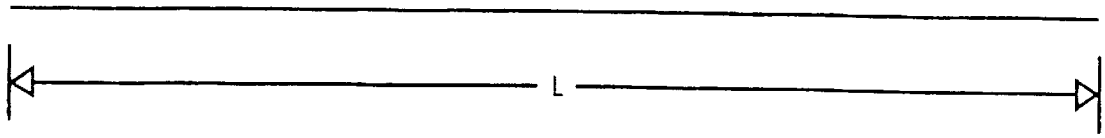
FIG. 3A illustrates an ideal, hypothetical uniform detection sensitivity along a leaky cable of fixed length L.
Figure 3B:
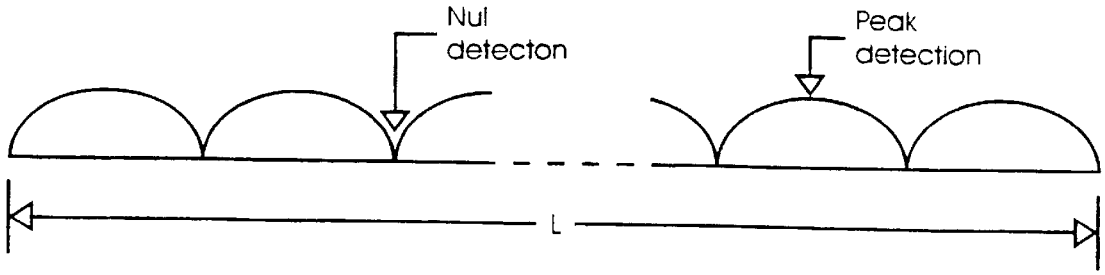
FIG. 3B illustrates the real detection sensitivity along a leaky cable of fixed length L when it is subjected to a single-frequency RF signal.
Figure 3C:
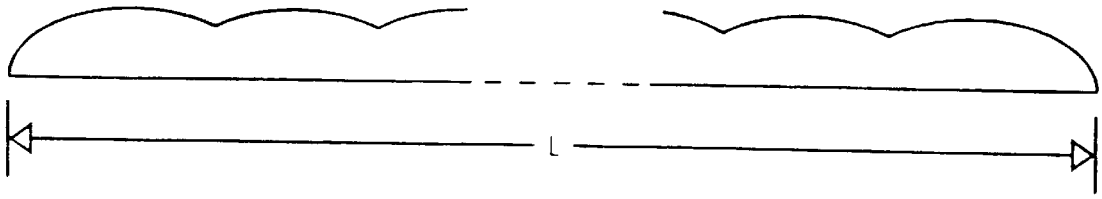
FIG. 3C illustrates the detection sensitivity when the cable of FIG. 3B is surrounded by an electrically-lossy medium.

The use of multiple transmission frequencies provides relatively uniform detection sensitivity along the length of the leaky cable. FIG. 3A illustrates that, for an ideal, hypothetical leaky cable, the detection sensitivity would be uniform through the length L of the cable. In fact, this would only occur with an infinitely long cable. When a cable of finite length is subjected to a single frequency signal, a surface wave propagates along the cable and is reflected at discontinuities, particularly the ends, though discontinuities may arise from conductive objects in the vicinity of the surface wave. As a result, standing waves occur, and the detection sensitivity exhibits a series of alternating nulls and peaks, as illustrated in FIG. 3B. As discussed hereinbefore, burying the cable in an electrically-lossy medium causes the detection sensitivity to become more uniform, as illustrated in FIG. 3C.

Figure 3D:
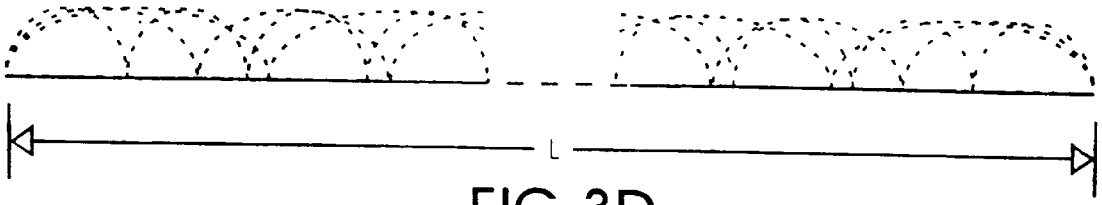
FIG. 3D illustrates detection sensitivity along the cable of FIG. 3B for each of four disparate frequencies of RF signal to which the cable is subjected.
Figure 3E:
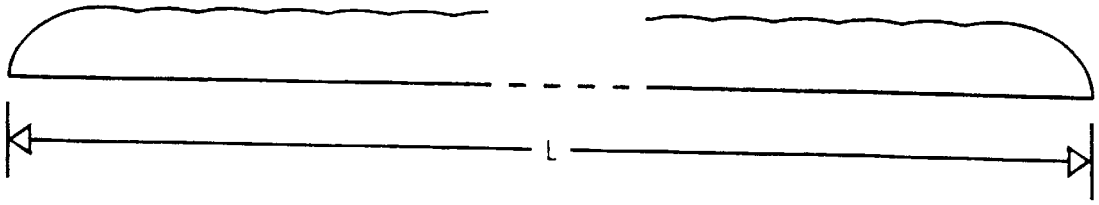
FIG. 3E illustrates the combined detection sensitivity along the cable of FIG. 3D.
Figure 4A:
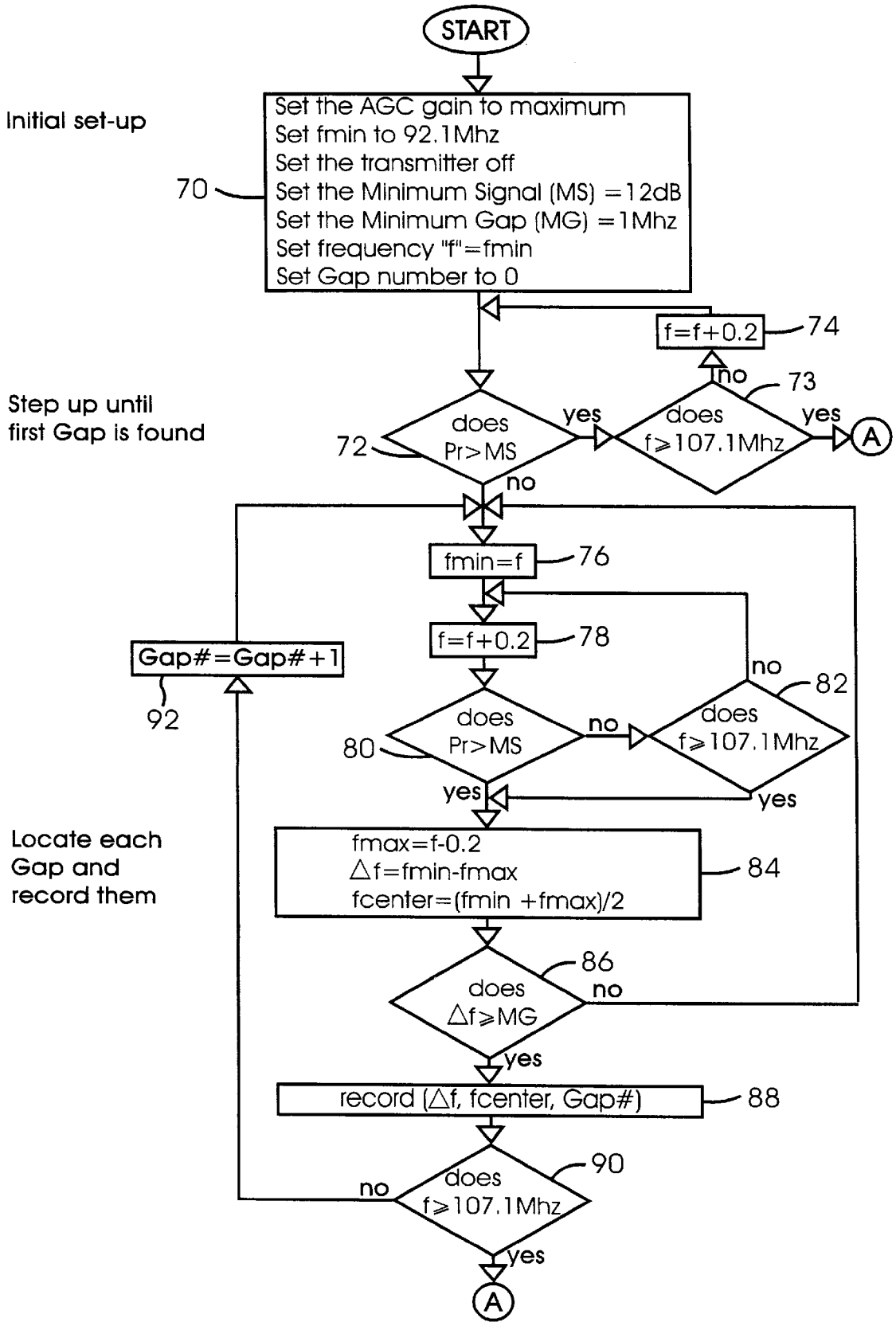
FIGS. 4A and 4B are a flowchart illustrating operation of the intrusion detection system of FIG. 1.
Figure 4B:
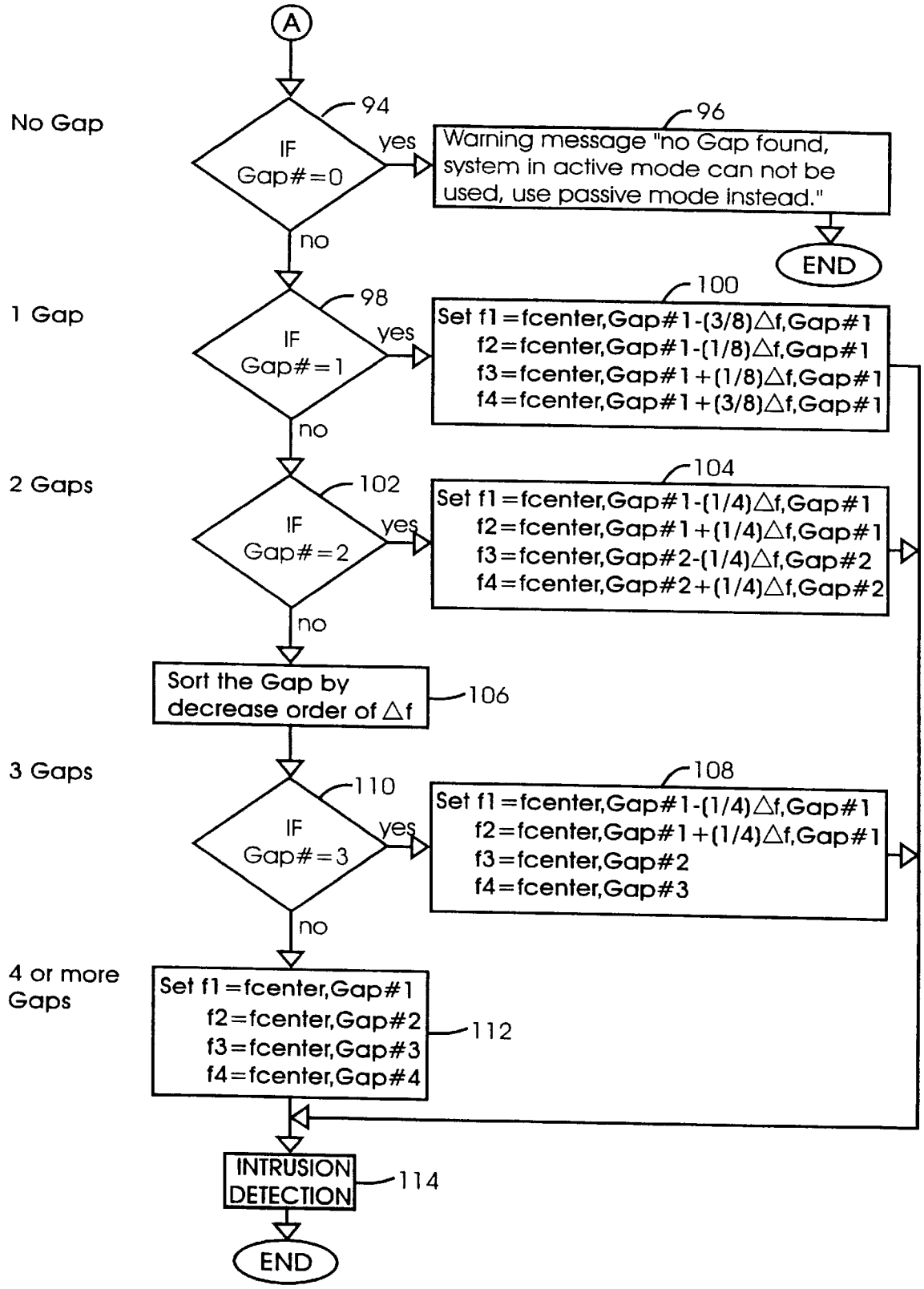

As explained earlier, it is not always convenient to bury the cable. Consequently, the approach taken by the present invention is to accept the existence of the standing waves and, rather than bury the cable to ameliorate their effect, use a plurality of difference frequencies with significant frequency spacing (at least five per cent and preferably about ten per cent bandwidth). As shown in FIG. 3D, standing waves will still occur, one for each frequency, but their null points will not coincide. Consequently, as illustrated in FIG. 3E, the detection sensitivity along the cable will be more uniform. Operation of the intrusion detection system to locate the quiet portions of the broadcast band, for use by its transmitter 14, is depicted in more detail in the flowchart of FIGS. 4A and 4B. FIG. 4A depicts the detection of the quiet portions and FIG. 4B depicts the selection the transmission frequencies. Referring first to FIG. 4A, in step 70, the microprocessor 32 performs the following initialization steps: (i) sets the gain of AGC 48 to maximum, so as to obtain maximum reception sensitivity; (ii) sets to 92.1 MHZ. the frequency variable $f_{min}$; (iii) turns the transmitter 14 off by means of amplifier 60; (iv) sets a minimum signal threshold to 12 dB. above a noise floor; (v) sets the minimum gap width to 1 MHz. (which corresponds to the bandwidth for five FM stations spaced 0.2 MHz. apart); (vi) sets equal to $f_{min}$ an initial frequency variable f for the receiver; and (vii) sets the number of the instant quiet portion equal to 0.

In decision step 72, the microprocessor 32 compares the amplitude of the received signal with the minimum signal level threshold of 12 dB. above the noise floor. If it is greater, decision step 73 determines whether or not the instant frequency f exceeds the upper limit of 107.1 MHz. and , if it does, exits to step 94 (FIG. 4B). If it does not, in function step 74 the microprocessor 32 increments the VCO 46 to increase the frequency f by 0.2 MHz. (which is equivalent to the frequency spacing between FM station allocation). The loop comprising steps 72 and 74 causes the frequency f to increment in steps of 0.2 MHZ. until step 72 indicates that the received signal level is below the 12 dB. threshold, i.e. the beginning of the first quiet portion (GAP 1) has been detected. Thus, when step 72 returns a negative result, because the signal level at that particular frequency increment f is below the threshold, in step 76, the microprocessor 32 sets $f_{min1}$ to that value of "f", establishing the lower limit of the first quiet portion or gap. Thereafter, step 78 increments the receiver frequency f by 0.2 MHz. and decision step 80 detects whether or not the received signal exceeds the 12 dB. threshold. If it does not, decision step 82 determines whether or not the current frequency f exceeds 107.1 MHZ., the upper limit of the operating band. If it does not, the microprocessor 32 returns to step 78 and increments the frequency by another 0.2 MHZ. The loop comprising steps 80 and 82 increments the frequency f in 0.2 MHZ. steps until either a signal level above the 12 dB. threshold is detected, or the upper limit of 107.1 MHZ. is reached, whereupon step 84 sets the variable $f_{max1}$ to the last recorded frequency f minus 0.2 MHZ., calculates the width $\Delta f_1$ of the first quiet portion or gap by subtracting $f_{min1}$ from $f_{min1}$, and determines its centre frequency $f_{centre1}$ as midway between $f_{min1}$ and $f_{max1}$. It should be noted that $f_{max1}$ is set to f–0.2 because the upper limit of the gap is 0.2 MHz. less than the instant frequency f.

In step 86, the microprocessor 32 compares the width of the quiet portion with the minimum acceptable width (MG), set to 1 MHz. If the width is less than 1 MHz., (to prevent chance of mutual interference), the microprocessor 32 returns to step 76 and repeats steps 76 through 84 for further frequency increments.

Once a quiet portion of the prescribed width has been found, in step 88, the microprocessor 32 records the parameters of the quiet portion in memory and in step 90 determines whether or not the instant frequency exceeds the upper limit of the operating range, vis. 107.1 MHZ. If it does not, in step 92, the microprocessor 32 increments the gap number to 2 and returns to step 76. The microprocessor 32 then repeats steps 76 to 92 to detect a second quiet portion, determine its parameters $\Delta f_2$, $f_{min2}$, $f_{max2}$ and $f_{centre2}$ and record them with the quiet portion number in memory. If the upper limit of the second quiet band is less than 107.1 MHZ., the microprocessor 32 will repeat steps 76 to 92 for a third quiet portion, and so on until the entire operating band has been scanned for quiet portions. When that has been done, step 90 returns a positive result and the microprocessor 32 proceeds to the frequency determination process of FIG. 4B.

Referring to FIG. 4B, in step 94, the microprocessor 32 accesses its memory and determines whether or not any quiet portions wider than 1 MHz. were detected. If no such quiet portions were detected, step 96 will return a warning message to the effect that the FM spectrum cannot be used and suggest that the use of an alternative system, such as that disclosed in U.S. Pat. No. 5,534,869 supra which uses signals from a commercial radio station.

If only one quiet portion was detected, as indicated by a negative result for decision step 94 and a positive result for decision step 98, in step 100 the microprocessor 32 calculates four transmission frequencies f1, f2, f3 and f4, where:- f1 is the centre frequency $f_{centre}$ minus three eighths of the bandwidth Δf1;

f2 is the centre frequency $f_{centre}$ minus one eighth of the bandwidth Δf1;

f3 is the centre frequency $f_{centre}$ plus one eight of the bandwidth Δf1;

f4 is the centre frequency $f_{centre}$ plus three eights of the bandwidth Δf1.

Hence, the four frequencies are spaced approximately equally across the band, and proceeds to intrusion detection step 114.

If several quiet portions were detected, step 98 returns a negative result and step 102 determines whether or not two quiet portions were detected. If so, in step 104, the microprocessor 32 calculates the four transmission frequencies so that f1 and f2 are in the first quiet portion and frequencies f3 and f4 are in the second quiet portion. In particular, f1 is calculated as the centre frequency $f_{centre1}$ of the first quiet portion minus one quarter of the bandwidth $\Delta f_1$ of the first quiet portion and f2 is calculated as $f_{centre1}$ plus one quarter of the bandwidth $\Delta f_1$ of the first quiet portion. The other two frequencies f3 and f4 are calculated as the centre frequency $f_{centre2}$ of the second quiet portion and third portion, respectively. Microprocessor 32 then proceeds to intrusion detection process 114.

If three quiet portions have been detected, step 102 returns a negative result and step 106 sorts the quiet portions in its memory in decreasing order according to their respective bandwidths $\Delta f_1$, $\Delta f_2$, $\Delta f_3$, and so on, i.e. the first being the widest. In step 110, the microprocessor 32 then determines whether or not there are three quiet portions or more. If there are three, in step 108 the microprocessor 32 calculates the four frequencies, the first two, f1 and f2, in the first (widest) quiet portion and the second two, f3 and f4, in the second and third quiet portions, respectively. Thus, f1 and f2 are calculated as the centre frequency $f_{centre1}$ of the first quiet portion minus and plus, respectively, one quarter of the bandwidth $\Delta f_1$ of the first quiet portion. The frequencies f3 and f4 are set to the centre frequencies $f_{centre2}$ and $f_{centre3}$ of the second and third quiet portions, respectively. The microprocessor 32 then proceeds to intrusion detection process 114.

If four or more quiet portions were detected, step 110 returns a negative result and, in step 112, microprocessor 32 sets the four transmission frequencies f1, f2, f3 and f4 equal to the centre frequencies $f_{centre1}$, $f_{centre2}$, $f_{centre3}$ and $f_{centre4}$ of the four quiet portions or, if there are more than four quiet portions, to the centre frequencies of the four widest quiet portions. The microprocessor 32 then proceeds to intrusion detection process 114.

In the intrusion detection process 114, the microprocessor 32 causes the transmitter 14 to transmit at each of the four frequencies f1, f2, f3 and f4, using frequency-hopping techniques that are known to persons skilled in this art and so need not be described here. As described previously, the receiver 20 tracks the transmitter 14 and receives signals at the same set of frequencies and the microprocessor processes them to detect an intruder. The microprocessor 32 may use known techniques to process the received signals to detect perturbations caused by an intruder in the vicinity of the leaky cable 10. For particulars of such a technique, the reader is directed to U.S. Pat. No. 5,510,766, the contents of which are incorporated herein by reference.

Figure 5A:
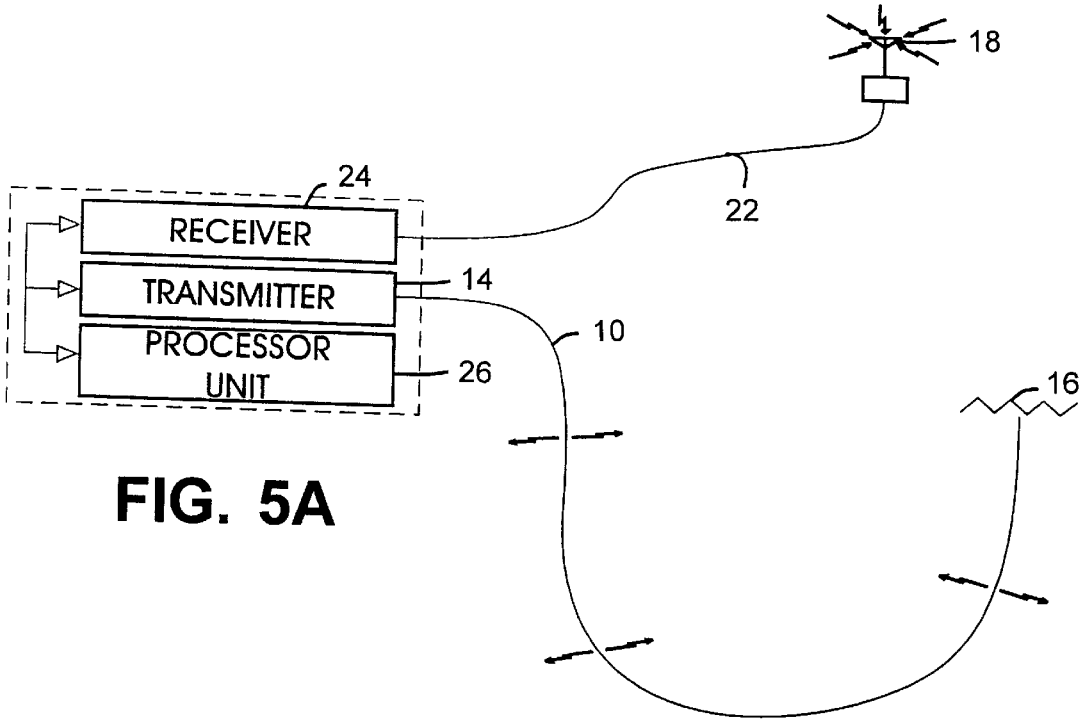
FIGS. 5A to 10 illustrate various configurations of intrusion detection systems embodying the invention.
Figure 5B:
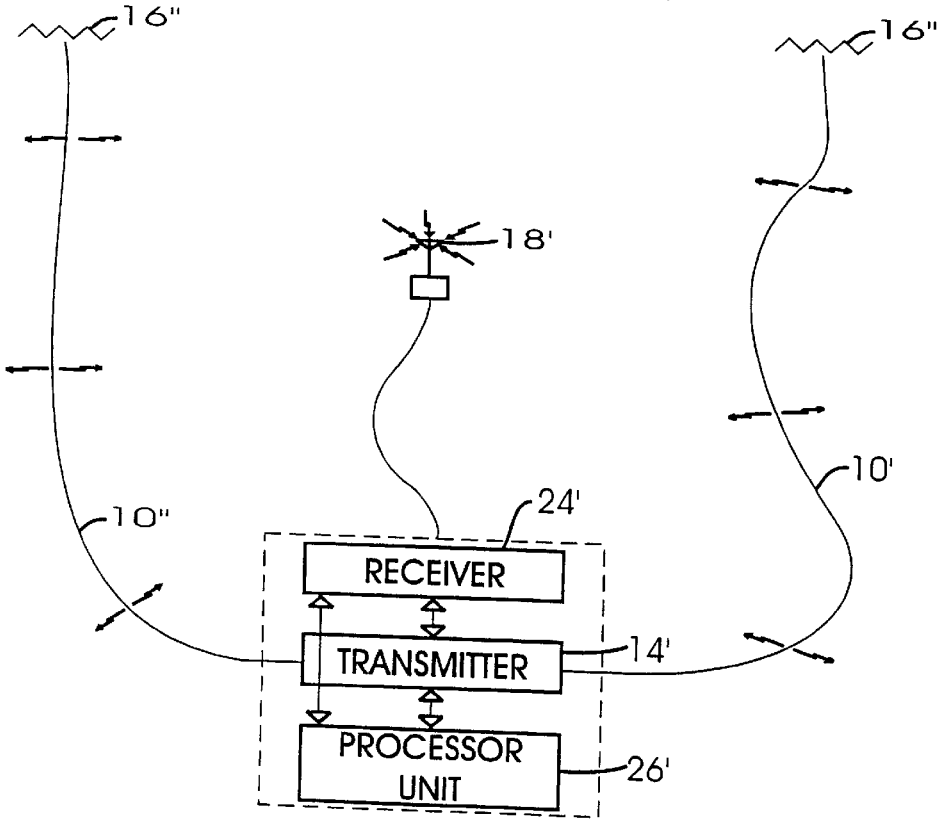

The invention is not limited to the intrusion detection system configuration illustrated in FIG. 1. An advantage of embodiments of the present invention is that they provide for considerable flexibility in system configuration and physical layout, examples of which are illustrated in FIGS. 5A–10. Thus, FIG. 5A illustrates in simplified form the system of FIG. 1. the system depicted in FIG. 5B, two leaky cable antennae 10" are connected to the transmitter 14' and extend one each side of the reception antenna 18', before being terminated termination impedances 16". The receiver 24' and the processor unit 26' are located with the transmitter 14'. The transmitter 14' uses time multiplexing to transmit signals to both of the leaky cables and protect two corresponding zones.

Figure 6:
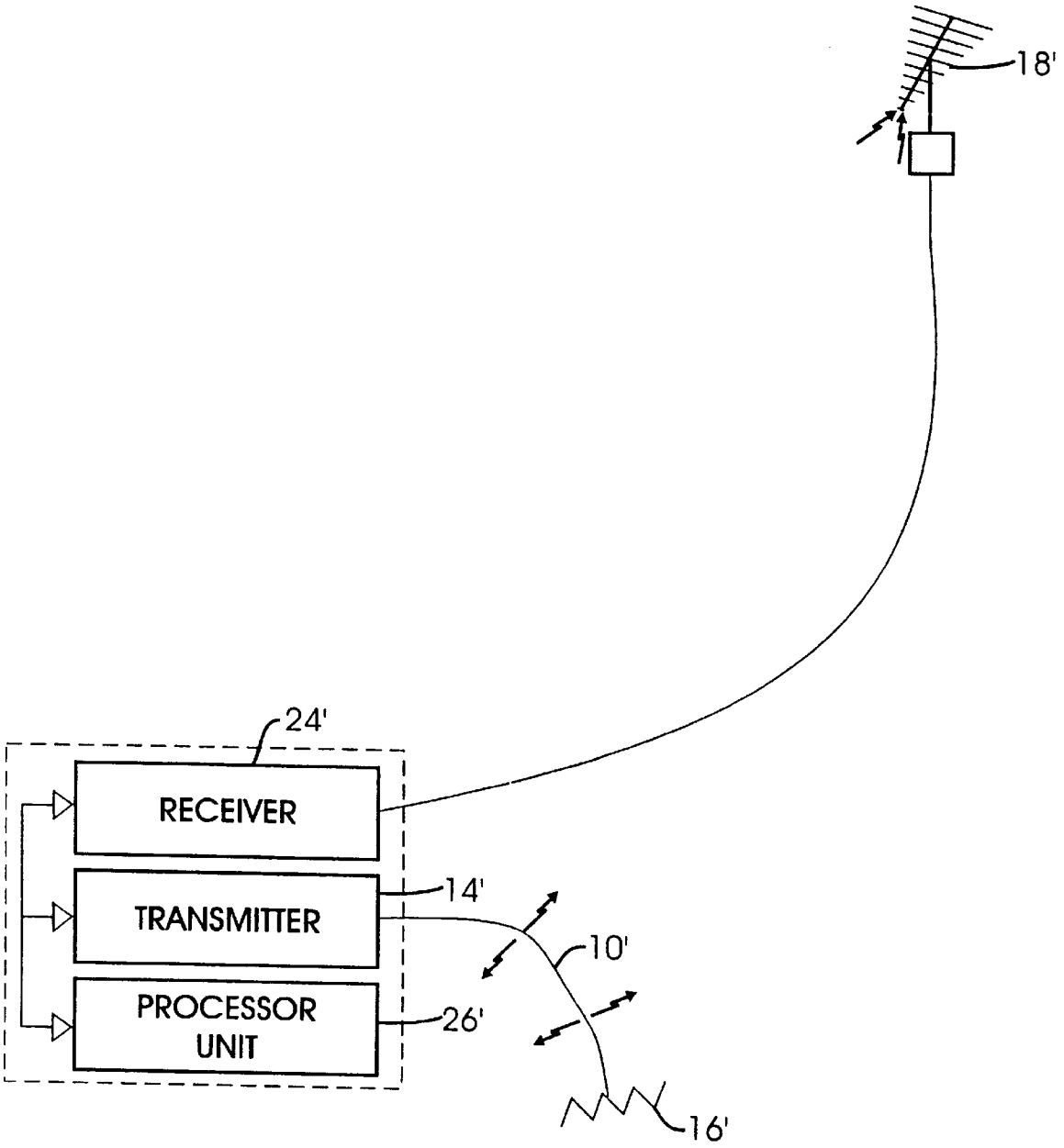

In the system of FIG. 6, the distance between the leaky cable 10 and the reception antenna 18' is relatively large and/or the leaky cable 10' relatively short. In order to allow for the consequent reduction in signal strength, the reception antenna 18' is a directional antenna pointing towards the leaky cable.

Figure 7:
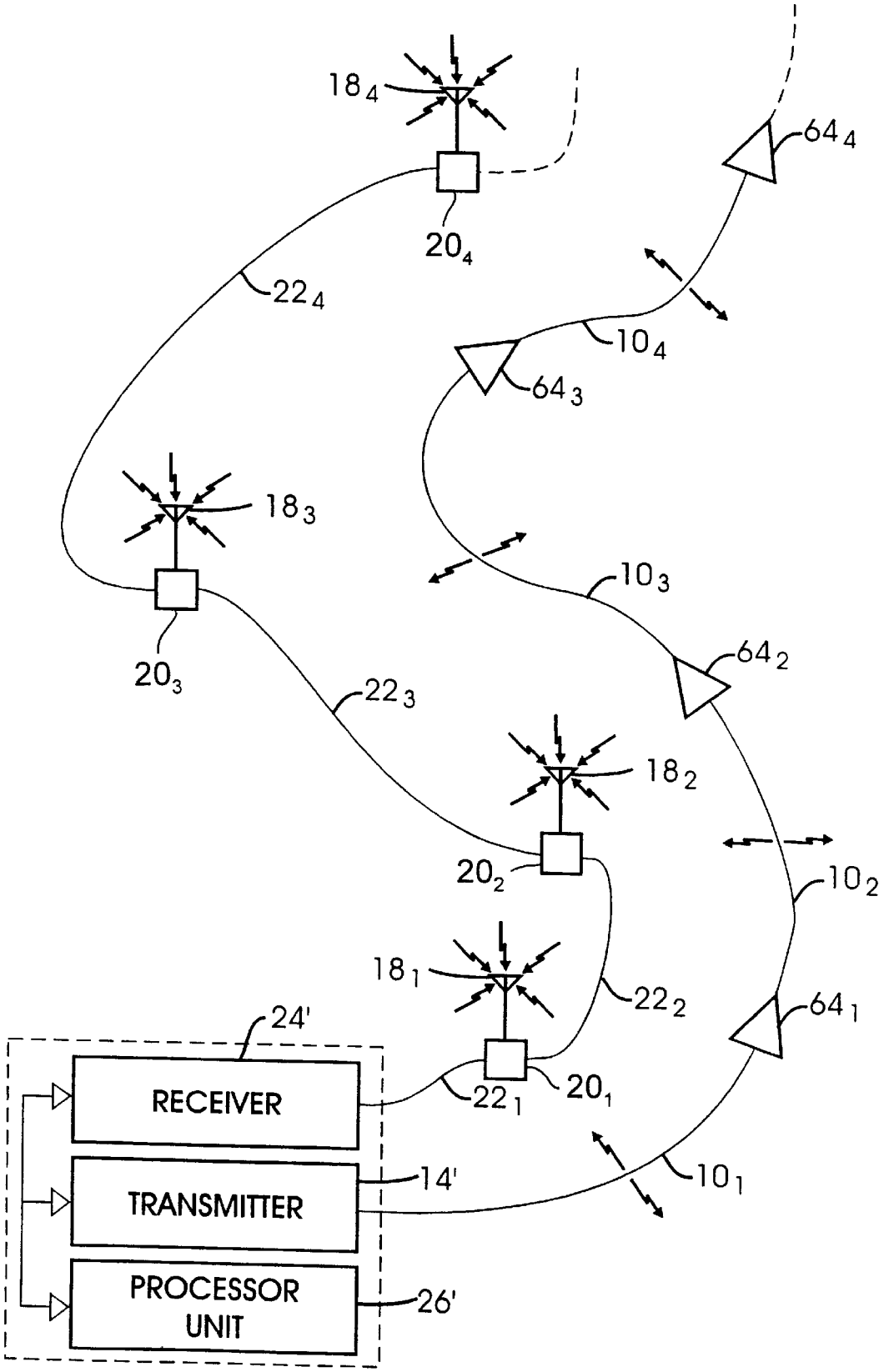

In the system of FIG. 7, a series of leaky cables $\mathbf{10}_1$, $\mathbf{10}_2$, $\mathbf{10}_3$, and $\mathbf{10}_4$, each about 150 meters long, are connected in tandem between the transmitter 14' and a termination impedance (not shown). A corresponding plurality of "repeater" amplifiers $\mathbf{64}_1$, $\mathbf{64}_2$, $\mathbf{64}_3$ and $\mathbf{64}_4$ are interposed one between each pair of leaky cables and serve to boost the signals and maintain substantially the same transmission signal level in each of the leaky cables $\mathbf{10}_1$ to $\mathbf{1}_4$. A corresponding series of reception antennae $\mathbf{18}_1$, $\mathbf{18}_2$, $\mathbf{18}_3$ and $\mathbf{18}_4$ and their associated receivers $\mathbf{20}_1$ to $\mathbf{20}_4$ are connected in tandem by coaxial cables $\mathbf{22}_1$ to $\mathbf{22}_4$, each also about 150 meters long, to receiver unit 24'. Each of the reception antennae $\mathbf{18}_1$ to $\mathbf{18}_4$ is adjacent to, and monitors, a respective one of the leaky cables $\mathbf{10}_1$ to $\mathbf{10}_4$. The antennae $\mathbf{18}_1$ to $\mathbf{18}_4$ depicted in FIG. 8 are omnidirectional. It would be possible, however, to have a plurality of directional antennae each pointing to a corresponding one of the leaky cables, but not adjacent to it.

Figure 8A:
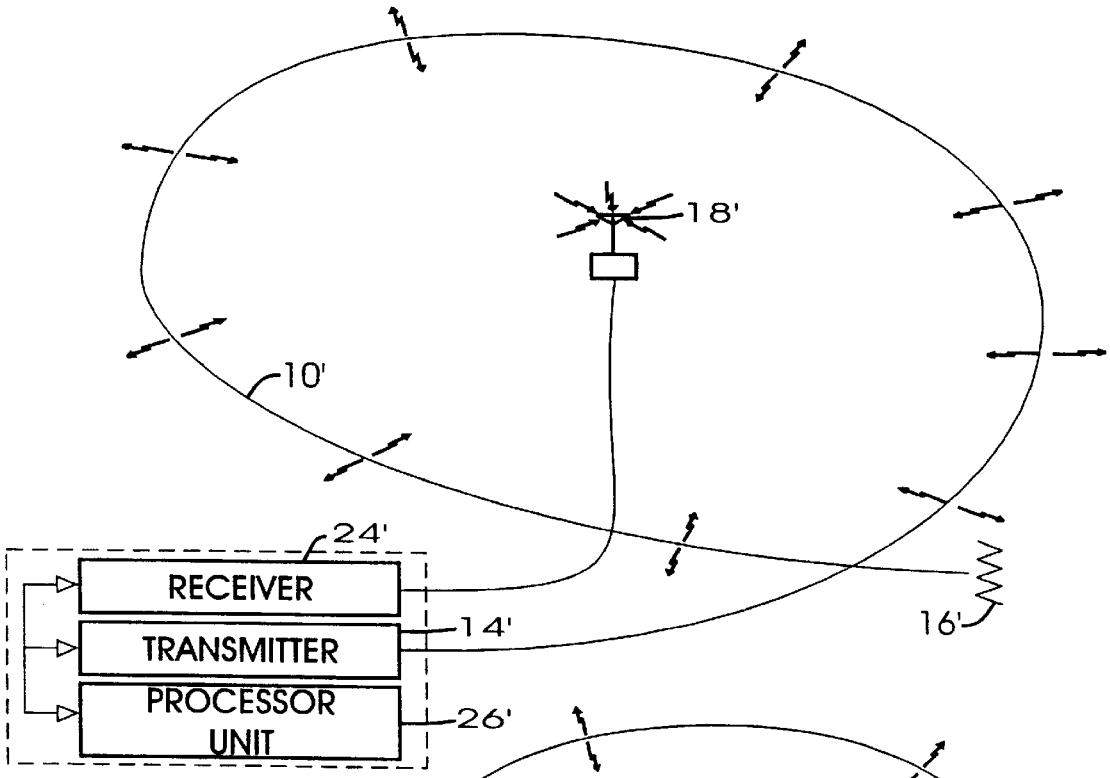
Figure 8B:
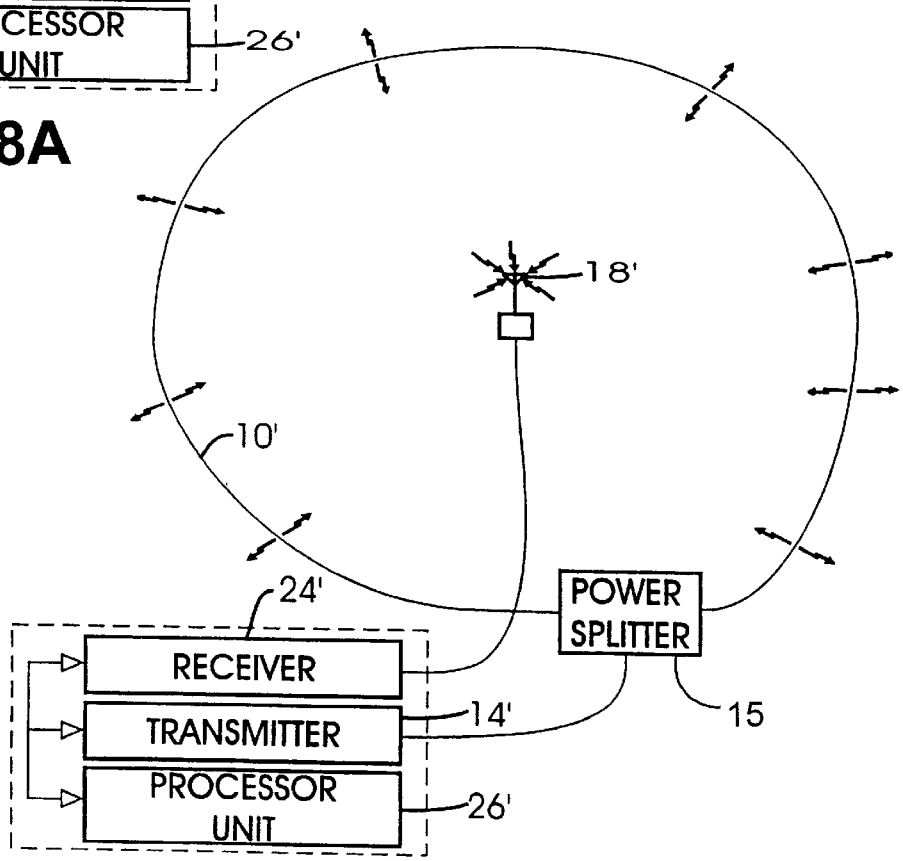

In the system depicted in FIG. 8A, a single leaky cable 10' is connected at one end to the transmitter 14, disposed in a loop around the reception antenna 18' and terminated by termination impedance 16'. The reception antenna is an omnidirectional antenna which receives signals from the whole length of the leaky cable 10'. As before, in order to determine that an intruder is crossing the leaky cable, the processor unit may employ the procedure disclosed in U.S. Pat. No. 5,510,766. It is envisaged that the configuration could be modified by omitting the termination impedance 16 and connecting both ends of the leaky cable 10' to the transmitter 14 by way of a power splitter 15, as shown in FIG. 8B.

Figure 9:
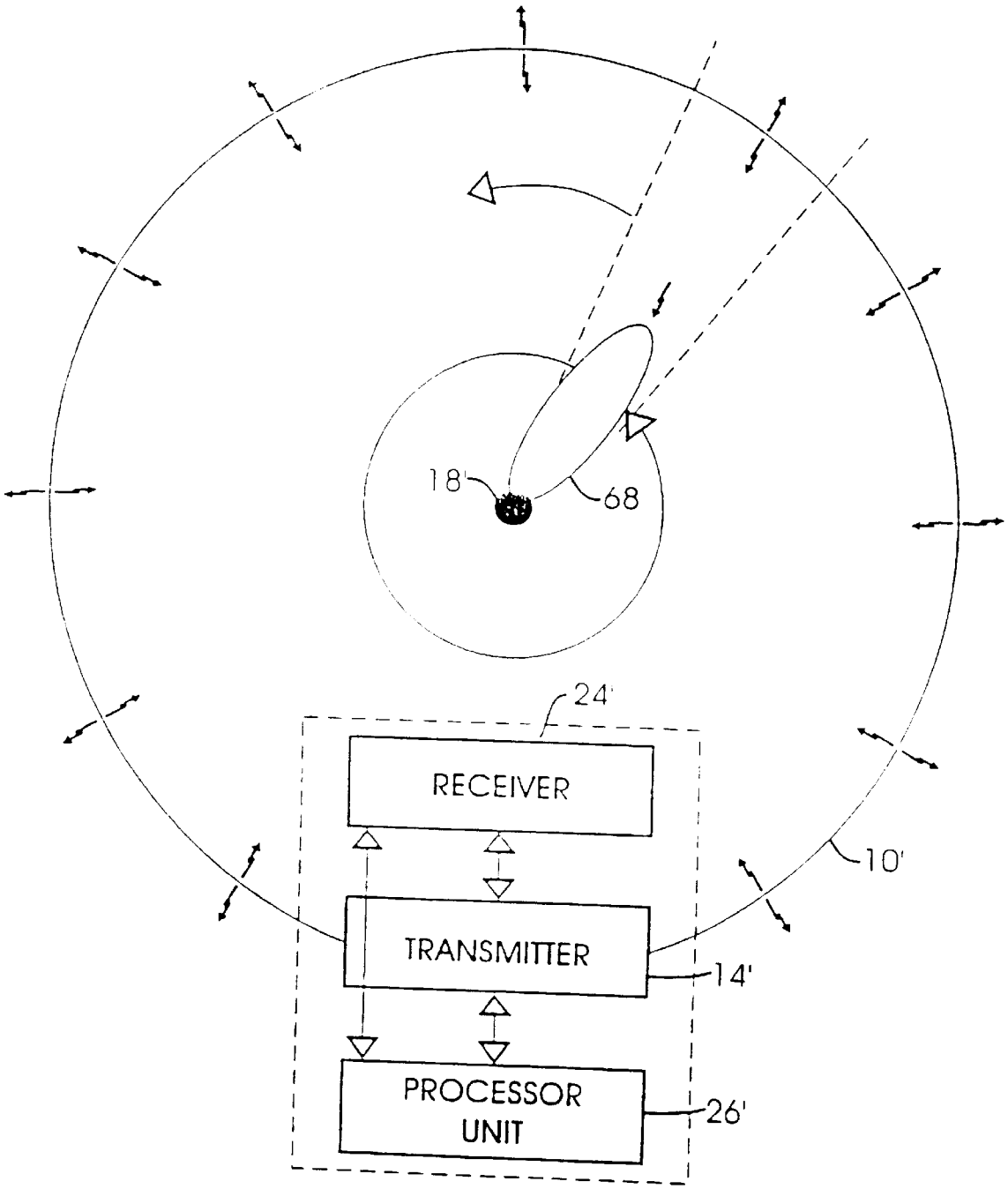

In the system depicted in FIG. 9, the leaky cable 10' has its ends both connected to the transmitter 14 and again forms a loop around the reception antenna 18' which is electrically-steerable, for example a phased array antenna, or mechanically-steerable, for example a rotatable dish antenna. The ends of the leaky cable 10' may be connected in common to the transmitter by a power splitter (not shown). Alternatively, they might be connected directly to the transmitter for time-multiplexed operation. The lobe 68 of the antenna 18' rotates through 360 degrees to scan, stepwise, the whole length of the leaky cable 10'. The position at which the intruder crosses the leaky cable can be determined readily by determining the position of the antenna using, for example, known plan position indication techniques. Preferably, the antenna 18' is as small as possible, yet its beamwidth as narrow as possible. In practice, a four-element phased array antenna should be satisfactory.

It should be appreciated that the antenna need not scan through 360 degrees but could step through an arc appropriate to the position and length of the leaky cable. It would also be possible to have several separate leaky cables, as in the embodiment of FIG. 7, and control the steerable antenna to scan, in steps, each leaky cable in turn.

Figure 10:
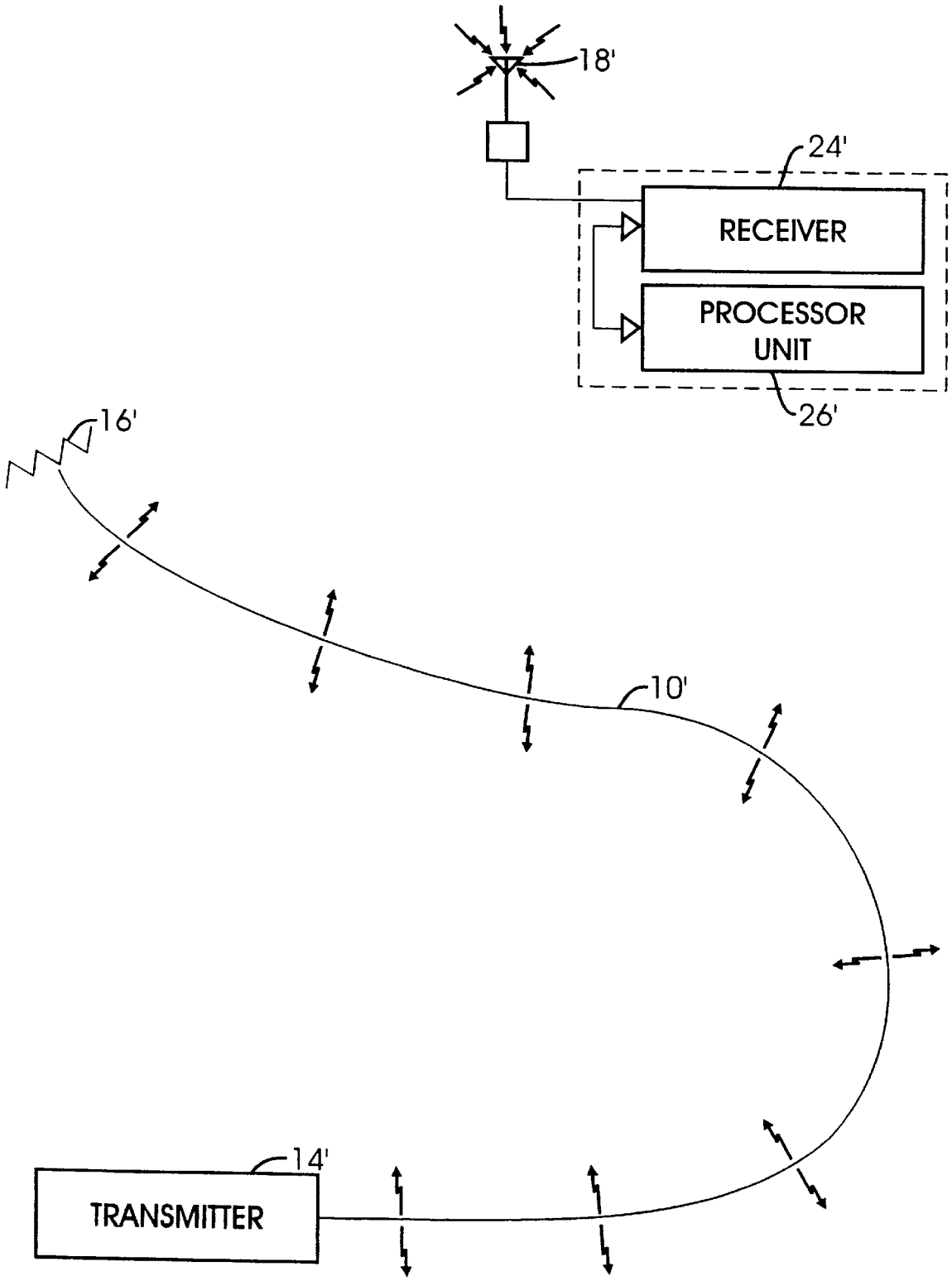

Finally, FIG. 10' illustrates the leaky cable 10 connected to the transmitter 14' as before but the receiver 24' and processor unit 26' are located physically adjacent the reception antenna 18', i.e. spaced from the transmitter 14'. In this case, the transmitter and receiver are not synchronized. Instead, each has its own local and IF oscillators and the microprocessor does not control the transmitter, i.e. the control line 62 (FIG. 1) is omitted. In operation, the microprocessor will still cause the receiver to scan the frequency band and display the frequency spectrum to the user to guide the user in identifying the quiet portions. The user will then set the transmitter manually to the four frequencies, at which it will transmit continuously.

Although the above-described embodiments of the invention each have the leaky cable(s) connected to the transmitter 14, it is envisaged that the invention could also be implemented with the leaky cable(s) connected to the receiver and the antenna(e) 18 used to transmit the signals from the transmitter 14, at least where a country's regulations permit higher radiation levels.

INDUSTRIAL APPLICABILITY

An advantage of embodiments of the present invention is that the preselection of quiet portions in which to operate allows the transmission signal level to be low; so low in fact that it is below the level at which regulatory permission is required and permits the system to operate in regular FM radio bands, such as the usual FM radio band of 88–108 MHz. This is advantageous because it allows multiple frequencies to be used, which reduces the effect of standing wave or null problems and facilitates deployment of the leaky cable without a surrounding electrically-lossy medium, for example above ground, while maintaining uniform detection sensitivity.

Further advantages are realised because operation i the 92–107 MHz. band allows readily available components to be used, which keeps costs down, and because one half of the wavelength of the signal is close to the height of a human being, giving better discrimination between human intruders and small animals and consequent reduction of false alarms. Moreover, the FM band, by its nature, has quiet portions, with consequent reduced risk of potential interference.

What is claimed is:

1. An intrusion detection system comprising:

a transmitting antenna and a receiving antenna, one of which is an open transmission line/leaky cable, a transmitter unit connected to the transmitting antenna; and a receiver unit connected to the receiving antenna;

wherein the transmitter unit transmits signals, by way of the transmitting antenna, at several disparate radio frequencies;

and the receiver unit receives by way of the receiving antenna signals corresponding to the transmitted signals;

the system further comprising means for detecting perturbations in the received signals caused by an intruder in the vicinity of the open transmission line/leaky cable and in dependence thereupon determining the presence of an intruder.

2. An intrusion detection system comprising:

a transmitting antenna and a receiving antenna, one of which is an open transmission line/leaky cable, a transmitter unit connected to the transmitting antenna and a receiver unit connected to the receiving antenna; and a control unit for controlling the transmitter unit and the receiver unit, the control unit controlling the receiver unit to scan one or more sections of the radio spectrum, with the transmitter unit not transmitting, and detect one or more relatively quiet portions of said spectrum in which instant received signal levels are lower than a predetermined threshold, the control unit selecting a plurality of disparate frequencies in said one or more relatively quiet portions and subsequently causing the transmitter to transmit signals by way of the transmitting antenna, at said disparate frequencies;

the receiver unit receiving signals corresponding to the transmitted signals;

the control unit detecting perturbations in the received signals caused by an intruder in the vicinity of the open transmission line/leaky cable and in dependence thereupon determining the presence of an intruder.

3. A system according to claim 2, wherein the control unit causes the receiver unit to scan at least a portion of the frequency-modulated broadcast band from 87.9 MHz. to 107.9 MHz.

4. A system according to claim 3, wherein the control unit causes the receiver unit to scan only from about 92 MHz. to about 107 MHz.

5. A system according to claim 2, 3 or 4, if only one quiet portion is detected, the control unit selects the disparate frequencies so as to optimize their separation from each other and upper and lower limits of said quiet portion.

6. A system according to claim 1, 2, 2, or 4, wherein the said disparate frequencies have a bandwidth of at least 5 per cent of their mean frequency.

7. A system according to claim 6, wherein the said disparate frequencies have a bandwidth of about 10 per cent of their mean frequency.

8. A system according to claim 2, wherein the control unit is operable, in the event that a plurality of quiet portions are detected, to select the disparate frequencies such that each quiet portion has a pair of the disparate frequencies assigned thereto, the pair of disparate frequencies being each spaced from a respective one of upper and lower limits of the quiet portion by one quarter of the bandwidth of said quiet portion.

9. A system according to claim 8, wherein the control unit is operable, in the event that three quiet portions are detected, to determine the widest of the three quiet portions, select a first tow of the disparate frequencies within the widest quiet portion and a second two of the disparate frequencies one within each of the other two quiet portions, the said two disparate frequencies being spaced from respective upper and lower limits of said widest quiet portion by one quarter of the bandwidth of said widest quiet portion and the second two disparate frequencies each being at the centre frequency of the quiet portion to which it is assigned.

10. A system according to claim 2, wherein the control unit is operable, in the event that four or more quiet portions are detected, to assign one of the disparate frequencies to each of the four widest quiet portions, each disparate frequency being at the centre of the quiet portion to which it is assigned.

11. A system according to claim 5, wherein the said disparate frequencies have a bandwidth of at least 5 per cent of their mean frequency.

12. A system according to claim 11, wherein the said disparate frequencies have a bandwidth of about 10 per cent of their mean frequency.

13. A method of detecting intruders using an intrusion detection system comprising a transmitting antenna and a receiving antenna, one of which is an open transmission line/leaky cable, a transmitter unit connected to the transmitting antenna and a receiver unit connected to the receiving antenna, the method comprising the steps of:

(i) using the receiver unit, scanning one or more sections of the radio spectrum, with the transmitter unit not transmitting, and detecting one or more relatively quiet portions of said spectrum in which instant received signal levels are lower than a predetermined threshold, (ii) selecting a plurality of disparate frequencies in said one or more relatively quiet portions;

(iii) using the transmitter unit, transmitting signals by way of the transmitting antenna at the disparate frequencies;

(iv) using the receiver unit, receiving signals corresponding to the transmitted signals; and (v) detecting perturbations in the received signals caused by an intruder in the vicinity of the open transmission line/leaky cable and in dependence thereupon determining the presence of an intruder.

14. A method as claimed in claim 13, using a said intrusion detection system further comprising a control unit for controlling operation of the transmitter unit and the receiver unit, the method further wherein the steps of scanning the preselected radio band, detecting the quiet portions, selecting a plurality of disparate frequencies, transmitting signals at the disparate frequencies, and receiving the corresponding signals are carried out automatically by the control unit.

15. A method as claimed in claim 14, wherein setting of the transmitter unit to transmit at the disparate frequencies is controlled manually.

* * * * *